US011179825B2

(12) United States Patent
Wehrmann

(10) Patent No.: US 11,179,825 B2
(45) Date of Patent: Nov. 23, 2021

(54) FLOOR GRINDING APPARATUS HAVING DUST SEALING RINGS

(71) Applicant: WOLFF GmbH & Co. KG, Ilsfeld (DE)

(72) Inventor: Frank Wehrmann, Bad Oeynhausen (DE)

(73) Assignee: WOLFF GmbH & Co. KG, Ilsfeld (DE)

( * ) Notice: Subject to any disclaimer, the term of this patent is extended or adjusted under 35 U.S.C. 154(b) by 615 days.

(21) Appl. No.: 16/172,051

(22) Filed: Oct. 26, 2018

(65) Prior Publication Data

US 2019/0126434 A1 May 2, 2019

(30) Foreign Application Priority Data

Oct. 26, 2017 (EP) ..... 17198520

(51) Int. Cl.
*B24B 55/10* (2006.01)
*B24B 55/05* (2006.01)
(Continued)

(52) U.S. Cl.
CPC ..... *B24B 55/102* (2013.01); *A47L 11/164* (2013.01); *B24B 7/18* (2013.01);
(Continued)

(58) Field of Classification Search
CPC ..... B24B 7/18; B24B 7/186; B24B 23/02; B24B 23/028; B24B 55/04; B24B 55/05;
(Continued)

(56) References Cited

U.S. PATENT DOCUMENTS 3,719,966 A 3/1973 Lamont
5,125,190 A * 6/1992 Buser ..... B24B 55/102 451/359
(Continued)

FOREIGN PATENT DOCUMENTS

CN 204525071 U 8/2015
EP 0215476 A2 3/1987
(Continued)

OTHER PUBLICATIONS

European Search Report dated Dec. 20, 2017 issued in corresponding EP 17198520.3 application (8 pages).
(Continued)

*Primary Examiner* — Eileen P Morgan
(74) *Attorney, Agent, or Firm* — Millen, White, Zelano & Branigan, P.C.; William Nixon

(57) ABSTRACT

The present invention relates to a floor grinding apparatus (100) with a housing (110) having an interior space (111) open to one side, a carrier plate (120) rotatably mounted in the interior space (111) for receiving abrasives, and drive unit (130) adapted to rotate the carrier plate (120), the housing (110) having an inner dust sealing ring (112) with at least one recess (115), wherein the inner dust sealing ring (112) divides the interior space (111) into an inner portion (113) and an outer portion (114), and wherein the carrier plate (120) is disposed in the inner portion (114), at least one extraction opening (116) disposed in the outer portion (114), and an outer dust sealing ring (117) enclosing the interior space (111), the inner dust sealing ring (112) and the outer dust sealing ring (117) being arranged to define a common working plane parallel to the plane of rotation of the carrier plate (120).

15 Claims, 3 Drawing Sheets

(51) Int. Cl.

| | |
|---|---|
| ***B24B 7/18*** | (2006.01) |
| ***B24B 23/02*** | (2006.01) |
| ***A47L 11/164*** | (2006.01) |
| *A47L 11/206* | (2006.01) |

(52) U.S. Cl.
CPC ..... *B24B 7/186* (2013.01); *B24B 23/02* (2013.01); *B24B 55/05* (2013.01); *B24B 55/10* (2013.01); *A47L 11/206* (2013.01); *B24B 23/028* (2013.01)

(58) Field of Classification Search
CPC ..... B24B 55/052; B24B 55/06; B24B 55/10; B24B 55/102
USPC ..... 451/350, 353, 359, 451, 453, 456
See application file for complete search history.

(56) References Cited

U.S. PATENT DOCUMENTS

| | | | | |
|---|---|---|---|---|
| 5,445,558 | A * | 8/1995 | Hutchins | B24B 55/10 451/344 |
| 5,791,979 | A * | 8/1998 | Duncan | B24B 55/102 451/359 |
| 5,974,626 | A | 11/1999 | Wood et al. | |
| 6,004,192 | A * | 12/1999 | Bavelloni | B24B 9/10 451/178 |
| 6,027,399 | A * | 2/2000 | Stewart | B24B 23/02 451/353 |
| 6,454,640 | B1 * | 9/2002 | Siedler | B24B 23/02 451/357 |
| 7,887,395 | B2 * | 2/2011 | Weiford | B24B 55/102 451/359 |
| 8,764,518 | B2 * | 7/2014 | McCutchen | B24B 55/05 451/359 |
| 2005/0287938 | A1 * | 12/2005 | Kodani | B24B 55/102 451/359 |
| 2011/0092141 | A1 * | 4/2011 | McCutchen | B24B 55/05 451/451 |

FOREIGN PATENT DOCUMENTS

| | | | |
|---|---|---|---|
| FR | 2117834 | A1 | 7/1972 |
| FR | 2195177 | A5 | 3/1974 |
| JP | 10-277938 | A | 10/1998 |
| WO | 2011/061104 | A1 | 5/2011 |

OTHER PUBLICATIONS

English Abstract of EP 0215476 A2 published Mar. 25, 1987.
English Abstract of JP 10277938 A published Oct. 20, 1998.
English Abstract of CN 204525071 U published Aug. 5, 2015.

* cited by examiner

FLOOR GRINDING APPARATUS HAVING DUST SEALING RINGS

The present invention relates to a floor grinding apparatus having dust sealing rings.

A variety of floor grinding apparatuses, such as disclosed in DE 20 2013 010 625 U1, is being used for processing a floor. Such floor grinding apparatuses generally comprise a carrier plate for carrying an abrasive, drive unit to move the carrier plate, an extraction opening to extract the dust produced, and a dust sealing ring.

When grinding floor surfaces, a large amount of dust is generated which is spread throughout the room necessitating tedious cleaning of the floor after the grinding process. Vacuum cleaners are being used which are adapted to remove the dust immediately after it has been formed. However, a significant amount of dust may escape from the environment of a floor grinding apparatus before the dust can be collected by the vacuum cleaner.

In light of the above, it is an object of the present invention to reduce the contamination of the environment caused by the amount of dust generated during processing when operating a floor grinding apparatus.

According to the invention, this object is achieved by a floor grinding apparatus with the features of patent claim 1.

Accordingly, a floor grinding apparatus is provided. The floor grinding apparatus comprises a housing having an interior space which is open to one side, a carrier plate rotatably supported in the interior space for receiving an abrasive, and drive unit adapted to rotate the carrier plate, wherein the housing comprises an inner dust sealing ring having at least one recess, at least one extraction opening disposed in the outer portion, and an outer dust sealing ring enclosing said interior space, said inner dust sealing ring dividing said interior space into an inner portion and an outer portion, said carrier plate being disposed in said inner portion, and said inner dust sealing ring and said outer dust sealing ring being disposed so as to define a common working plane parallel to the plane of rotation of said carrier plate.

The invention is based on the concept to guide the dust generated during floor processing through a recess in the inner dust sealing ring towards the extraction opening. The outer dust sealing ring prevents the leakage of both dust guided through the recess as well as dust escaping elsewhere through the inner dust sealing ring.

Therefore the dust produces may be extracted particularly effectively, as it may either be guided directly to the extraction opening or retained in the outer portion of the interior space long enough for it to be captured by the extraction opening.

Advantageous embodiments and modifications result from the depending claims as well as from the description with reference to the accompanying drawings.

According to an embodiment, the floor grinding apparatus may also include an extraction unit which is operably engaged with at least one extraction opening. The integration of the extraction unit into the floor grinding apparatus eliminates the need for a separate extraction unit.

According to a further exemplary embodiment, multiple extraction openings may be provided, wherein each extraction opening is connected to the extraction unit by means of a separate tube. In this way, tubes of the simplest possible configuration may be used, making them particularly easy to manufacture, assemble, and maintain.

According to another exemplary embodiment, the housing may have a flattened disc shape. This enables the floor grinding apparatus to reach areas of the floor that are otherwise difficult to access, such as underneath radiators mounted on a wall.

According to another exemplary embodiment, the carrier plate may be supported such that it may be able move in one direction parallel to the rotation axis. This ensures that the attached abrasive, regardless of its thickness, rests on the surface to be processed.

According to another exemplary embodiment, the carrier plate may be configured to hold several abrasives in a ring-shaped arrangement. In this way, the entire surface to be processed is being covered and individual abrasives may be replaced without great effort if required.

According to a further embodiment, the drive unit may be in the form of an electric motor. Electric motors are particularly advantageous for use in enclosed spaces, as they cause significantly less impact with respect to noise and exhausts when compared to internal combustion engines.

According to a further embodiment, the floor grinding apparatus may also include a battery connected to the drive unit. This means that the floor grinding apparatus may also be used in places where there is no electric supply.

According to another exemplary embodiment, the floor grinding apparatus may have an equal number of recesses and extraction openings.

According to a further embodiment, each extraction opening may correspond to a recess. This ensures that the dust generated during processing is directed particularly effectively to the respective extraction opening.

According to a further embodiment, the inner dust ring may have two recesses and the housing may have two extraction openings, the recesses and their corresponding extraction openings being located on opposite sides of the inner portion. This configuration provides a particularly advantageous tradeoff between the smallest possible number of extraction openings and the maximum possible extraction of the resulting dust.

According to another exemplary embodiment, the inner dust sealing ring and the outer dust sealing ring may have brushes. This ensures that the resulting dust may not escape through the dust sealing rings even when working on floors with uneven surfaces.

According to a further embodiment, at least one recess may be adapted as a recess in the inner dust sealing ring. This is a particularly simple way of implementing the recess.

According to a further embodiment, at least one of the exhaust openings may be open at an angle of 45° with respect to the working plane towards the interior space. This facilitates the extraction of the resulting dust, as the dust is subjected to a horizontal speed by the rotation of the floor processing.

According to another exemplary embodiment, the floor grinding apparatus may also have at least two rollers which are arranged offset from the working level. This facilitates transport of the floor grinding apparatus from one location to the next.

The above mentioned embodiments and further aspects may be combined with each other, as long as it is sensible. Further possible embodiments, further aspects, and implementations of the invention also include combinations of features of the invention described before or in the following with regard to the exemplary embodiments, without being explicitly mentioned. In particular, the person skilled in the art will also add individual aspects as improvements or additions to the respective basic embodiment of the present invention.

BRIEF DESCRIPTION OF THE DRAWINGS

This invention will now be explained in more detail below using the exemplary embodiments given in the schematic drawings. In the figures.

Figure 1:
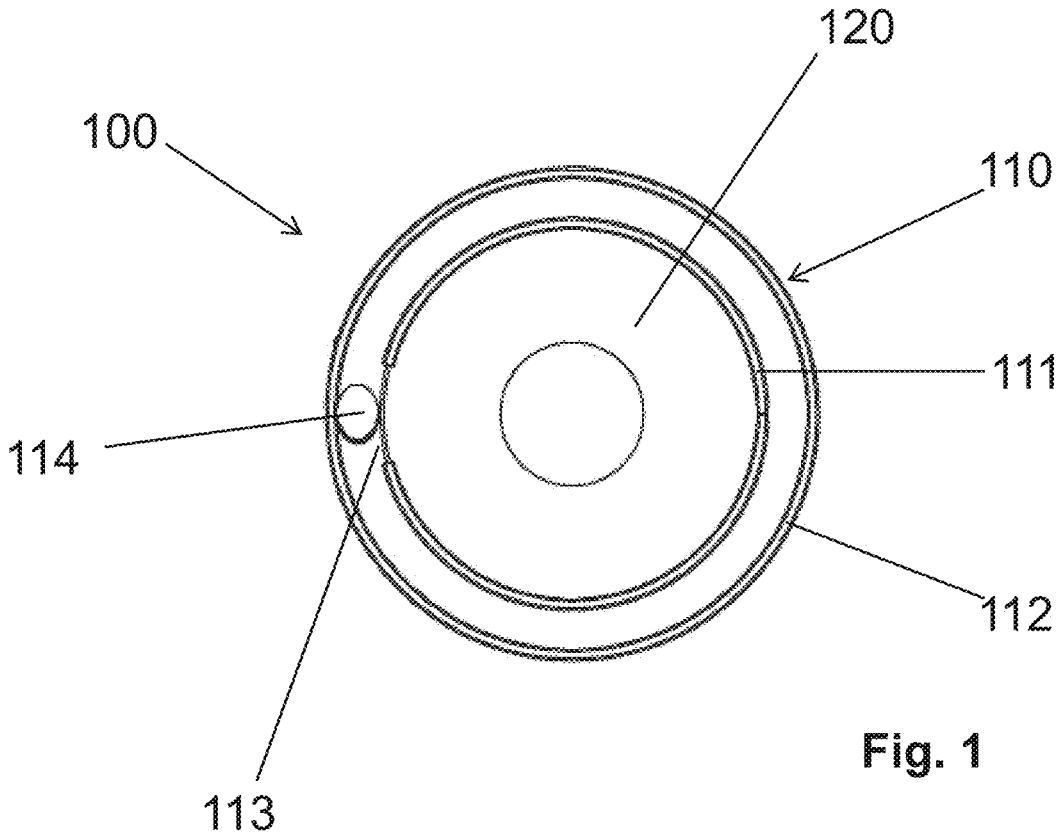
FIG. 1 is a schematic bottom view of a first exemplary embodiment of a floor grinding apparatus.

The enclosed figures are intended to provide a better understanding of the embodiments of the invention. They show preferable embodiments and help to describe the principles and concepts of the invention when combined with the description. Other embodiments and many of the advantages mentioned will result from the drawings. The elements of the drawings are not necessarily to scale.

In the figures of the drawing, like elements, features and components having the same function and effect are indicated by like reference signs, unless otherwise specified.

FIG. 1 shows a schematic bottom view of a floor grinding apparatus 100. The illustration shows the side of the floor grinding apparatus 100 when facing the working surface. A disc-shaped housing 110 defines an interior space visible from this perspective. Centrally arranged in the cylindrical interior space is a circular, rotatably supported carrier plate 120 to which one or more abrasives (not shown) may be attached. The housing 110 comprises a circular inner dust sealing ring 111 which encloses the carrier plate 120 and divides the interior space into an inner portion and an outer portion. The inner dust sealing ring 111 further comprises a recess 113 in the form of a recess of the inner dust sealing ring 111. In the outer portion there is disposed a circular extraction opening 114 adjacent to and associated with the recess 113. The interior space is completely enclosed by an outer dust sealing ring 112 of the housing.

With the floor grinding apparatus 100 in operation, both the abrasive(s) attached to the carrier plate 120 as well as the inner dust sealing ring 111 and the outer dust sealing ring 112 abut against the surface to be processed. When the carrier plate 120 rotates, the abrasive removes floor material, which is thrown away by the abrasive as dust. The inner dust sealing ring 111 advantageously prevents the escape of at least a large amount of the dust and guides it through the recess 113 from the inner portion into the outer portion. In the outer portion, the dust is extracted by means of negative pressure which is applied to the extraction opening 114. The outer dust sealing ring 112 prevents the dust from escaping from the outer portion and thus the interior space. Also the remainder of the dust escaping through the inner dust sealing ring 111 at locations other than the recess 113 is retained by the outer dust sealing ring 112 in the outer portion until it is advantageously extracted through the extraction opening 114.

The housing 110 may be made of a variety of materials, such as synthetic material, metal, or a combination of both. Synthetic materials usually have a low weight, which may be advantageous when carrying the floor grinding apparatus 100, but a high weight of the floor grinding apparatus 100 may also be desired when operating the apparatus in order to ensure a sufficient contact pressure of the abrasive to the floor surface to be worked on. The housing 110 may therefore also be adapted to increase the overall weight by means of additional weights. Such weights may be removed for the transport of the floor grinding apparatus 100, and only reattached shortly before the floor grinding apparatus 100 is put into operation. A metal housing 110 may also be used to prevent static charging of the dust caused by friction, which could possibly lead to a dust explosion. In this regard, the extraction unit, to which the extracted dust is transported, may also be provided with metallic components.

In the exemplary embodiment shown, the carrier plate 120 is adapted to hold a disc-shaped abrasive. This abrasive may be attached in any way, for example by means of insert or Velcro connections. The carrier plate 120 may also be configured to hold more than one abrasive. Advantageously, these multiple abrasives are then arranged in such a way that they grind off the entire floor surface under the carrier plate 120 during rotation. The abrasives may be paper-type abrasives or diamond-type abrasives.

In the exemplary embodiment described, the manner in which the inner dust sealing ring 111 and the outer dust sealing ring 112 are formed is not explicitly shown. It is advantageous that the inner dust sealing ring 111 and the outer dust sealing ring 112 are adapted as brush rings, which may ensure a seal against dust even on uneven floors. It is also conceivable to adapt the inner dust sealing ring 111 and/or the outer dust sealing ring 112 in the form of a rubber ring or the like. Rubber rings are extremely durable and therefore have a long service life. They are also easy to replace.

In the exemplary embodiment shown in FIG. 1, the recess 113 and the extraction opening 114 are arranged adjacent to each other. This is particularly advantageous as the dust guided through the recess 113 is captured directly by the extraction opening 114. However, it is also conceivable to arrange the recess 113 and the extraction opening 114 at a distance from each other.

Figure 2:
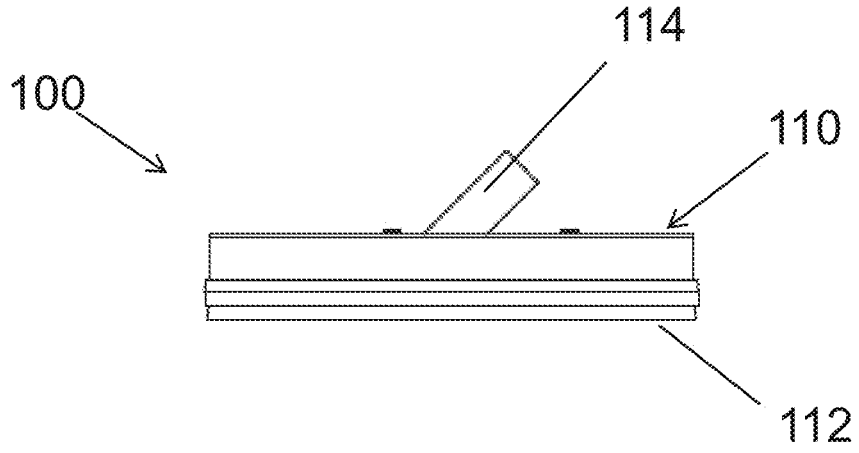
FIG. 2 is a schematic side view of the first exemplary embodiment of FIG. 1.

FIG. 2 shows a schematic side view of the floor grinding apparatus 100 of FIG. 1. In this view, the housing 110, the extraction opening 114 and the outer dust sealing ring 112 are visible. In this exemplary embodiment, the housing 110 has a flattened disc shape.

In the exemplary embodiment shown, the extraction opening 114 has for example an angle of 45° with respect to the working plane of the floor grinding apparatus. The extraction opening 114 is aligned in such a way as to extract the dust, which is also subjected to a rotational speed by the rotation of the carrier plate. Of course, other angles are also conceivable.

Figure 3:
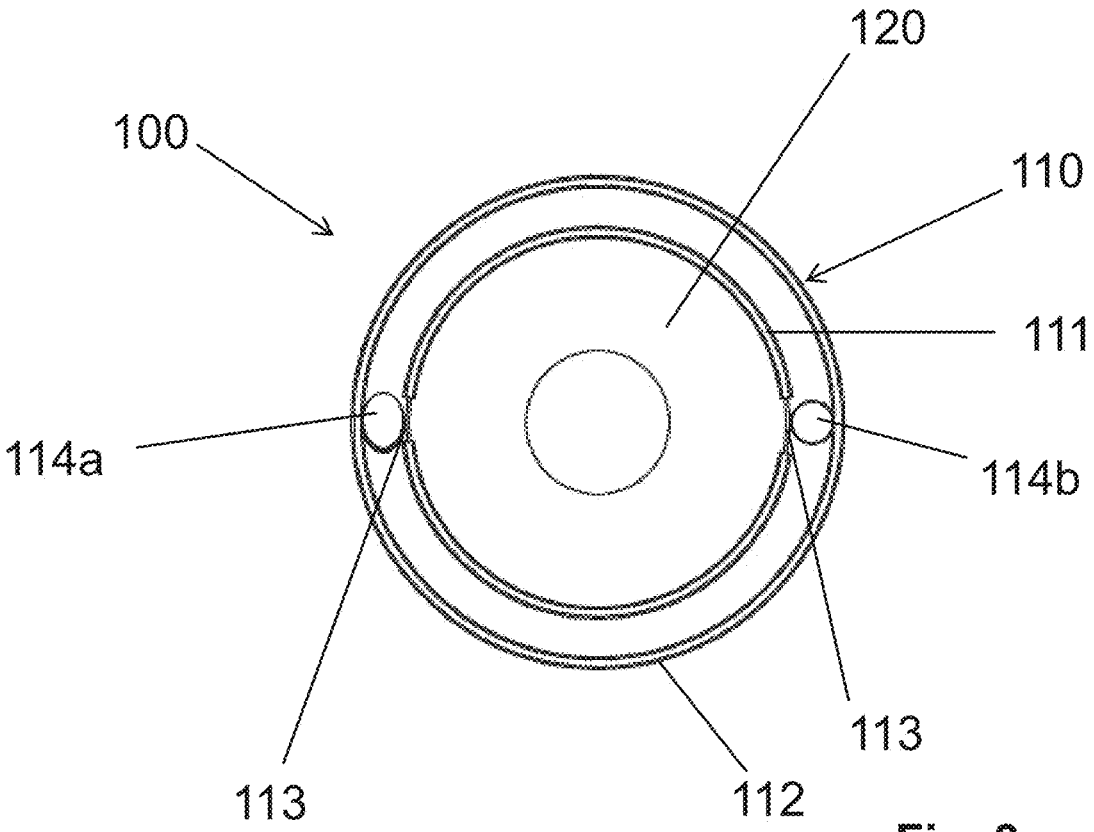
FIG. 3 is a schematic bottom view of a second exemplary embodiment of a floor grinding apparatus.

FIG. 3 shows a schematic profile view of a second exemplary embodiment of a floor grinding apparatus 100. The exemplary embodiment shown here differs from that shown in FIG. 1 in that two recesses 113 and two extraction openings 114*a*, 114*b* are provided. Each of the two extraction openings 114*a*, 114*b* corresponds to one of the recesses 113, respectively. For example, the recesses 113 and the respective corresponding extraction openings 114*a*, 114*b* are arranged on opposite sides of the inner portion. The arrangement shown here is particularly advantageous, but other arrangements and orientations are also conceivable within the scope of the present invention.

In this exemplary embodiment, advantageously the dust produced during the processing of the floor surface may be guided on both sides of the carrier plate 120 through the recesses 113 and then extracted directly at the respective extraction openings 114*a*, 114*b*. The interior space may therefore be effectively covered by the effect of the extraction of the two extraction openings 114*a*, 114*b*.

Figure 4:
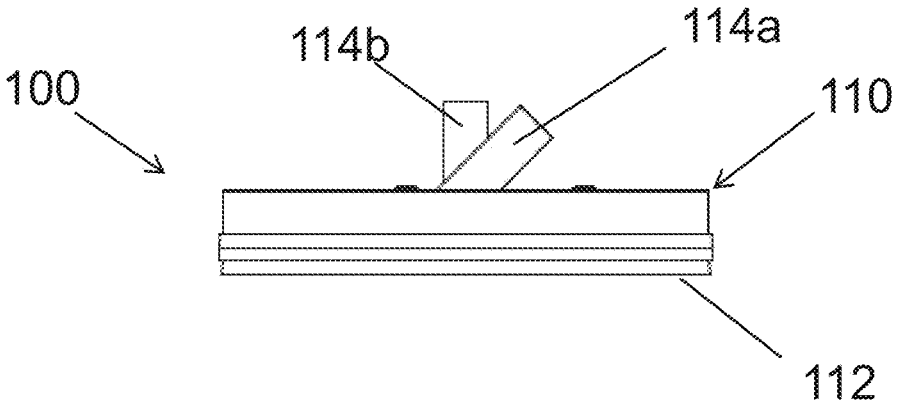
FIG. 4 is a schematic side view of the second exemplary embodiment of FIG. 3.

FIG. 4 shows a schematic side view of the floor grinding apparatus 100 of FIG. 3. In this view the housing 110, the two extraction openings 114*a*, 114*b* and the outer dust sealing ring 112 are visible.

In this exemplary embodiment, one of the two extraction openings 114*a* has an angle of 45° with respect to the working plane of the floor grinding apparatus 100. This extraction opening 114*a* is aligned in such a way as to extract the dust, which is also subjected to a rotational speed by the rotation of the carrier plate. The other extraction opening 114*b* is aligned perpendicular to the working plane of the floor grinding apparatus 100. This orientation provides an advantageous tradeoff between maximizing the extraction of dust and guiding a tube attached to the 114*b* extraction port in a direction leading to an extraction unit.

Figure 5:
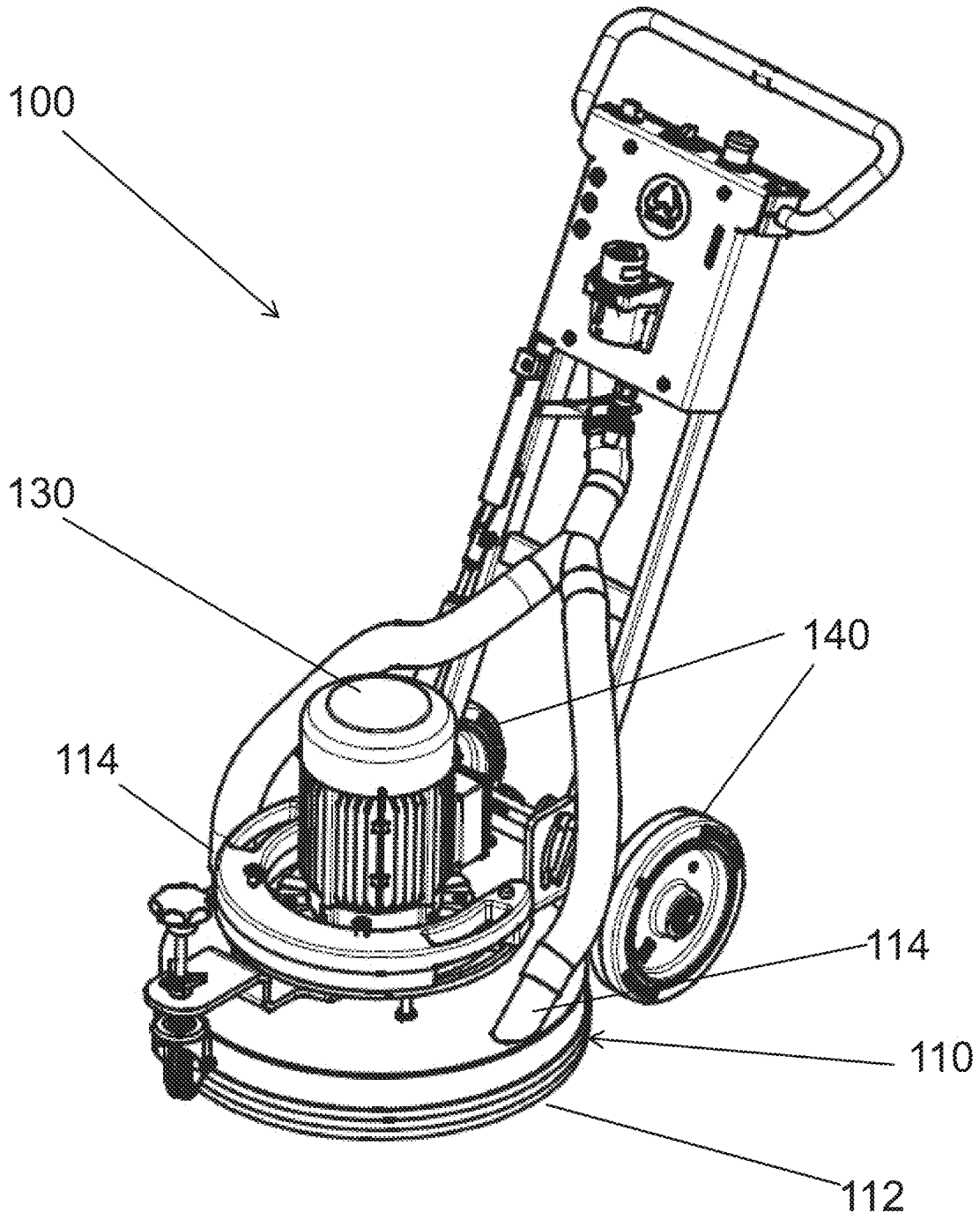
FIG. 5 is a schematic top view of a third exemplary embodiment of a floor grinding apparatus.

FIG. 5 shows a schematic diagonal view of a floor grinding apparatus 100 according to a third exemplary embodiment. In this view the housing 110, two extraction openings 114 and the outer dust sealing ring 112 are visible. On the upper side of the housing 110 there is a drive unit 130 which is connected to the carrier plate 120 which is not visible in this case. Two rollers 140 are also mounted to the housing.

The drive unit 130 shown here is in the form of an electric motor comprising an integrated rechargeable battery. The battery is not visible in FIG. 5. This embodiment is particularly advantageous, as an electric motor is a particularly user-friendly implementation, since an electric motor operates relatively quietly and produces no exhaust gases. It is also conceivable to provide a cable connection in addition to or in addition to the battery in order to operate the motor by means of the electrical mains. This avoids the need to interrupt work in order to replace or charge the battery. It is also conceivable to provide a combustion engine as a drive unit.

In the third exemplary embodiment, rollers 140 are arranged on the side of the floor grinding apparatus 100 facing the user and being offset from the working level of the floor grinding apparatus 100. In operation, the floor grinding apparatus 100 is tilted forwards and the abrasive, the inner dust sealing ring 111 and the outer dust sealing ring 112 rest on the floor surface to be worked on. Before and after operation, the floor grinding apparatus may be tilted backwards in such a way that only the rollers 140 touch the floor and the floor grinding apparatus 100 may be transported without great effort.

To facilitate transport, a third roller may also be provided on the front of the floor grinding apparatus 100, as shown in FIG. 5. This third roller is rotatable and may be adjusted in height. In operation, the third roller may be locked in a direction upwards, which allows components of the floor grinding apparatus 100, relevant for the operation, to be placed on the floor surface. Alternatively, the third roller may also be adjusted during operation such that, together with the two rear rollers, the third roller absorbs a portion of the weight of the floor grinding apparatus. This ensures a uniform grinding effect over the processed floor area. For transport, the third roller may be fixed further down such that only the two rear rollers 140 and the third roller touch the floor. Tilting the floor grinding apparatus 100 is no longer necessary, and the third roller increases the maneuverability of the floor grinding apparatus 100 due to its rotation capability.

The floor grinding apparatus 100 shown here also comprises a handle for maneuvering the floor grinding apparatus 100. Control elements for operating the drive unit 130 are also attached to this handle.

In the exemplary embodiment shown, the two extraction openings 114 communicate by means of a bifurcated tube with an external extraction unit which is not shown. It is also conceivable that an extraction unit is provided directly on the floor grinding apparatus 100. In this case it would be advantageous to connect each of the two extraction openings 114 to such an internal extraction unit by means of a separate tube.

REFERENCE SIGNS

100 floor grinding apparatus
110 housing
111 inner dust sealing ring
112 outer dust sealing ring
113 recess
114 extraction opening
114*a* extraction opening
114*b* extraction opening
120 carrier plate
130 drive unit
140 roller

The invention claimed is:

1. Floor grinding apparatus (100), comprising:
a housing (110) having an interior space open to one side;
a carrier plate (120) rotatably mounted in the interior space for receiving an abrasive; and a driving unit (130) adapted to rotate said carrier plate (120);
wherein the housing (110) comprises:
an inner dust sealing ring (111) having at east one recess (113);
an outer dust sealing ring (112) enclosing the interior space;
wherein the inner dust sealing ring (111) divides the interior space into an inner portion and an outer portion;
at least one extraction opening (114) disposed in said outer portion;
the carrier plate (120) is disposed in the inner portion; and
the inner dust sealing ring (111) and the outer dust sealing ring (112) are arranged to define a common working plane parallel to the rotational plane of the carrier date (120).

2. Floor grinding apparatus (100) according to claim 1, further comprising an extraction unit which is operatively connected to the at least one extraction opening (114).

3. Floor grinding apparatus (100) according to claim 2, wherein a plurality of extraction openings (114) is provided, each extraction opening (114) being connected to the extraction unit by means of a separate tube.

4. Floor grinding apparatus (100) according to claim 1, wherein the housing (110) is configured to have a flattened disc shape.

5. Floor grinding apparatus (100) according to claim 1, wherein the carrier plate (120) is movably supported in a direction parallel to the axis of rotation.

6. Floor grinding apparatus (100) according to claim 1, wherein the carrier plate (120) is adapted to receive a plurality of abrasives in a circular arrangement.

7. Floor grinding apparatus (100) according to claim 1, wherein the driving unit (130) is configured to be in the form of an electric motor.

8. Floor grinding apparatus (100) according to claim 7 further comprising a battery connected to the driving unit (130).

9. Floor grinding apparatus (100) according to claim 1, wherein the ground grinding apparatus (100) comprises an equal number of recesses (113) and extraction openings (114).

10. Floor grinding apparatus (100) according to claim 9, wherein each extraction opening (114) corresponds to a recess (113).

11. Floor grinding apparatus (100) according to claim 10, wherein the inner dust sealing ring comprises two recesses (113) and wherein the housing comprises two extraction openings (114), and wherein the recesses (113) and the extraction openings (114) associated therewith are each arranged on opposite sides of the inner portion.

12. Floor grinding apparatus (100) according claim 1, wherein the inner dust sealing ring (111) and the outer dust sealing ring (112) comprise brushes.

13. Floor grinding apparatus (100) according to claim 1, wherein the at least one recess (113) is formed as a recess in the inner dust sealing ring.

14. Floor grinding apparatus (100) according to claim 1, wherein at least one of the extraction openings (114*a*) is opened at an angle of 45° with respect to the working plane towards the interior space.

15. Floor grinding apparatus (100) according to claim 1, further comprising at least two rollers (140) which are arranged offset from the working plane.

* * * * *